US006015782A

United States Patent [19]

Petri et al.

[11] Patent Number: 6,015,782

[45] Date of Patent: Jan. 18, 2000

[54] PROCESS FOR MANUFACTURING BLEACHING COMPOSITIONS

[75] Inventors: Marco Petri, I-Angera Varese, Italy; Henry Cheng Na, Cincinnati, Ohio

[73] Assignee: The Procter & Gamble Company, Cincinnati, Ohio

[21] Appl. No.: 09/077,794

[22] PCT Filed: Dec. 7, 1995

[86] PCT No.: PCT/US95/15950

§ 371 Date: Jun. 5, 1998

§ 102(e) Date: Jun. 5, 1998

[87] PCT Pub. No.: WO97/20909

PCT Pub. Date: Jun. 12, 1997

[51] Int. Cl.[7] ..... C11D 3/395; C11D 3/48; C11D 7/54

[52] U.S. Cl. ..... 510/379; 510/370; 510/380; 510/405; 510/499

[58] Field of Search ..... 510/379, 380, 510/381, 370, 405, 499

[56] References Cited

U.S. PATENT DOCUMENTS

| | | | |
|---|---|---|---|
| 2,815,311 | 12/1957 | Ellis et al. | 167/18 |
| 3,583,922 | 6/1971 | McClain et al. | 252/99 |
| 3,749,672 | 7/1973 | Golton et al. | 252/95 |
| 4,051,056 | 9/1977 | Hartman | 252/99 |
| 4,300,897 | 11/1981 | Gray | 8/111 |
| 4,600,406 | 7/1986 | Corte | 8/108 R |
| 4,681,696 | 7/1987 | Bruegge et al. | 252/99 |
| 5,565,109 | 10/1996 | Sweeny | 210/755 |

*Primary Examiner*—Mark Kopec
*Assistant Examiner*—John M Petruncio
*Attorney, Agent, or Firm*—R. S. Echler, Sr.; K. W. Zerby; J. C. Rasser

[57] ABSTRACT

Process for manufacturing bleaching compositions comprising halogen bleach, a source of bromine and an organic or inorganic derived —$NH_2$ compound whereby improved bleaching performance is obtained and compositions obtainable by said process.

20 Claims, No Drawings

PROCESS FOR MANUFACTURING BLEACHING COMPOSITIONS

FIELD OF THE INVENTION

The present invention relates to a process for the manufacture of an alkaline bleaching composition comprising halogen bleach, a source of bromine, and an organic or inorganic-NH2 compound and to the compositions obtainable by this process.

BACKGROUND OF THE INVENTION

Hard surface cleaners can be in liquid, solid or viscous semi-solid form. Known liquid, solid and viscous semi-solid hard surface cleaners can comprise detergent surfactants, water and optionally certain organic solvents, builders, buffers, and/or perfumes as well as other adjunct materials. Solid and viscous semi-solid forms of hard surface cleaners may optionally comprise as adjunct ingredients one or several abrasive materials. Solid and viscous semi-solid, hard surface cleaners containing abrasive materials are used primarily as "scouring" agents. It has long been known that abrasive materials can be used in conjunction with hard surface cleaners to remove commonly encountered soils or soap scums.

The inclusion of hypohalite into hard surface cleaners has steadily grown. In fact, hypochlorite-containing hard surface cleaners are among the most effective materials available for cleaning since hypochlorite serves both as a strong oxidizer to assist in the chemical degradation, breakup and removal of stains and soils, and also as an inexpensive and effective disinfectant. This dual role of hypochlorite (as a bleach and disinfectant) together with its shelf stability and compatibility with other optional ingredients has contributed to the increased use of sodium hypochlorite or other positive halogen precursors, in the formulation of hard surface cleaners.

Kitchen and bathroom sink, tub, shower, toilet bowl and counter top surfaces, including vinyl, acrylic, and marble, are areas which have been the focus for developments in increased hard surface cleaning capacity. These surfaces are subject not only to exogenous bacteria, fungi and mildews endemic to most households, but to pathogens which are derived from urine and feces. Therefore, the inclusion of hypochlorite into these formulations as a strong and versatile disinfectant is an added benefit to consumers.

To insure proper hygiene and sanitary conditions, a formidable cleaning task must be undertaken to remove the undissolved sediments, grease, soap films, scums, hard water scale and rust stains that form on ceramic surfaces, counter tops and bathroom floors during normal usage. Cleaning is especially difficult in the case of hardened and dried soap films, scums, caked-on residues and scaling due to hard water/undissolved dirt where it is necessary to use more than simple wiping to remove the unwanted sediments.

It has now been suprisingly found that a bleach composition prepared by a process requiring pre-mixing together a source of bromine such as NaBr with a hypochlorite source, then combining this "pre-mix" with an —$NH_2$ compound yields a more effective bleaching composition. Without wishing to be limited by theory, it is believed that the following chemical reaction sequence in the pre-mixing step accounts for the formation of hypobromite when the hypochlorite source and the source of bromine are mixed together in the process according to the present invention.

$$OCl^- + Br^- \rightarrow OBr^- + Cl^-$$

Hypobromite, thus formed, being a bleaching agent in itself, is therefore a source of positive halogen and is susceptible to sequestration by the means provided in the present invention. In other words, it is believed that said source of bromine such as sodium bromide has the effect of converting a hypochlorite source into a more reactive and/or a more stable species, for example, hypobromite, thus providing for the full utility of the bleach formulated.

Suprisingly, a combination of an —$NH_2$ compound, which must be combined with the hypochlorite/bromine premix in a separate step, provides a composition having still more efficatious benefits, for example, the prevention of malodor on human skin when the bleaching compositions obtainable by the present process contact human skin.

There has been a long felt need to combine increased bleaching capacity with other ancillary benefits and for the consumer to obtain these bleaching compositions.

It is thus an object of the present invention to provide bleaching compositions that exhibit improved bleaching performance on the surfaces treated therewith and to have other benefits such as prevention of malodor on human skin as well as superior stability.

SUMMARY OF THE INVENTION

The present invention encompasses a process for manufacturing a bleaching composition comprising a halogen bleach, a source of bromine and an organic or inorganic derived —$NH_2$ compound. Said process includes the steps of:

i) mixing a source of hypochlorite and a source of bromine to form a pre-mix;

ii) selecting an organic or an inorganic derived —$NH_2$ compound;

iii) optionally mixing the selected —$NH_2$ compound with a carrier or/and an optional ingredient to form an —$NH_2$ composition; and iv) combining the pre-mix from step (i) with the —$NH_2$ compound of step (ii) or the —$NH_2$ composition of step (iii) to form a bleaching composition, wherein the pH of the bleaching composition is greater than 11.

It is an object of the present invention to provide a process for preparing bleaching compositions having a greater bleaching effectiveness.

It is also an object of the present invention to provide a process resulting in a bleaching composition having increased stability and shelf life.

It is a further object of the present invention to provide bleaching compositions that control malodor formation on human skin when the bleaching compositions come into contact with human skin.

All percentages, ratios and proportions herein are by weight, unless otherwise specified. All temperatures are in degrees Celsius (° C.) unless otherwise specified. All documents cited are, in relevant part, incorporated herein by reference.

DETAILED DESCRIPTION OF THE INVENTION

The present invention relates to a process for manufacturing bleaching compositions having improved efficacy against bleachable stains. The process according to the present invention can be summarized as comprising the following steps.

Step (i)—comprises a mixing step wherein a source of hypochlorite and a source of bromine are combined to form a pre-mix.

An essential ingredient of the present invention is the inclusion in step (i) of a suitable hypochlorite source. By "hypochlorite source" it is meant herein alkali metal or alkali earth metal hypochlorites, as well as alternative hypochlorite sources like hypochlorous acid, or chlorine or even organically derived sources of hypochlorite such as chloroisocyanurate. Preferred hypochlorite sources are according to the formula $M(OX)_y$ where: M is a member selected from the group consisting of sodium, potassium, magnesium, calcium, and mixtures thereof; O is an oxygen atom; X is a chlorine; and y is 1 or 2 depending on the charge of M. Particularly preferred hypochlorite source to be used according to the present invention are sodium hypochlorite, potassium hypochlorite, calcium hypochorite, and magnesium hypochlorite, and more preferably sodium hypochlorite.

The concentration level of hypochlorite in step (i) is not restricted to the levels commercially available to the formulator but may also comprise concentrations produced by a manufacturing-site process, for example, the passing of chlorine gas into an alkaline aqueous solution. The latter process example, depending upon the choice of alkali, allows the formulator to incorporate selected cations (e.g. $K^+$, $Ca^{2+}$) into the final formulation.

A further essential ingredient of the present invention is the inclusion in step (i) of the present process of a source of bromine. For the purposes of the present invention the term "source of bromine" is defined as "any material, whether organic or inorganic, used alone or otherwise in combination with other organic or inorganic materials comprising bromine, that serve as a source of bromide ion when the source of bromine is contacted with a suitable source of hypochlorite under the conditions of step (i) of the present invention". When this suitable source of bromine is mixed with the source of hypochlorite in step (i) a hypohalite species is formed which will subsequently undergo mediation by the —$NH_2$ material of steps (ii) or (iii). The formulator may select elemental bromine ($Br_2$), organic bromides such as N-bromosuccinimide, as well as preformed NaOBr and $Br^-$ yielding salts (e.g. NaBr) for use in this process. Suitable $Br^-$ yielding salts are according to the formula $M(X)_y$ where: a) M is a member selected from the group consisting of lithium, sodium, potassium, magnesium, calcium, copper, zinc, and mixtures thereof, and b) X is the radical bromide, bromate, and mixtures thereof, wherein y is 1 or 2. Particularly preferred $Br^-$ yielding salts are of the formula MX where M is a member selected from the group consisting of lithium, sodium, potassium, magnesium, calcium, copper, and zinc while the X is Br. Thus the preferred $Br^-$ yielding salts are the sodium and potassium salts of bromine, more preferably sodium and potassium bromide. For the purposes of the present invention, it is not important that at the time of forming the admixture in step (i) that all bromine have the same form. Some or all bromine may be added as $Br^-$.

Alternatively, chemical equilibrium can be used to establish the level and forms of available bromine. Therefore the formulator may choose to have all available bromine in a chemically combined form upon admixture with the source of hypochlorite in step (i) and thereby use the intrinsic equilibrium of the system to establish the level of $Br^-$.

Step (ii)—comprises selecting an organic or an inorganic derived —$NH_2$ compound.

A further essential ingredient of the present invention is the inclusion in step (ii) of the present process of an organic or inorganic derived —$NH_2$ compound. For the purposes of the present invention, the term "organic or inorganic derived —$NH_2$ compound" is defined as any —$NH_2$ material alone or in combination with other suitable —$NH_2$ compounds other than ammonia ($NH_3$) or salts thereof (e.g. NH4Cl), that provide a source of hypohalite mediation. Not wishing to be limited by theory, the mediation by the —NH2 compounds of the hypohalite species formed by the admixture of the hypochlorite and bromine compounds of step (i) of the present process, produces a product with superior bleaching performance and provides for the control of malodor formation on human skin.

Compounds suitable for selection as —$NH_2$ compounds in step (ii) of the present invention are those which, in their reaction with hypochlorous acid, favor N-bound chlorine over free chlorine or O-bound chlorine. Preferred —$NH_2$ compounds include —$NH_2$ compounds that have a characteristic hydrolysis constant, $K_H$, for the corresponding chloramine. This hydrolysis constant is given by:

$$K_H=[HOCl][RNH_2]/[RNHCl]$$

wherein $K_H$ is in the range from about $10^{-6}$ to about $10^{-9}$.

The corresponding hydrolysis reaction of the chloramine is given by:

$$RNHCl + H_2O \Longleftrightarrow HOCl + RNH_2,$$

this reaction being the equilibrium result of adding to a sample of pure water the chloramine RNHCl derived from the selected —$NH_2$ compound, $RNH_2$.

In the above, R denotes an organic or inorganic group other than H, consistent with the definition of the essential —$NH_2$ compound. R can, for example, be a moiety —$HSO_3$, in which case $RNH_2$ is sulfamic acid.

Hydrolysis constants such as the above are well known in the art and are defined conventionally. See, for example, Kirk Othmer's Encyclopedia of Chemical Technology, 3rd Ed., Vol. 5, article entitled "Chloramines and Bromamines", see especially page 567, and Kirk Othmer's Encyclopedia of Chemical Technology, 3rd Ed., Vol. 3, see especially pages 940–941, said articles being incorporated herein by reference.

—$NH_2$ Compounds respecting the above relationship include sulfamic acid, which is a preferred —$NH_2$ compound herein; in contrast, and for purposes of comparison, isocyanuric acid and the corresponding chloroisocyanurates do not respect the above relationship and thus, while use of isocyanurates is permitted as an optional ingredient (e.g. a source of hypochlorite), they cannot be used as the essential —$NH_2$ compound herein.

Examples of said —$NH_2$ compounds are sulphamic acid, sulphamide, p-toluenesulphonamide, benzenesulphonamide, melamine, cyanamide, alkyl sulfonamides, and mixtures thereof Particularly preferred herein are sulphamic acid, sulphamide or mixtures thereof. At pH levels of the present invention, which are greater than 11, the above mentioned —NH2 compounds may be de-protonated, that is they may be in the form of a salt and therefore due to expediency, ease of synthesis or preparation, or due to formulation practices the salt form of any or all of the above mentioned —NH2 compounds will suffice. Although any suitable cation will suffice for the purposes of the present invention, sodium, potassium, lithium, magnesium, calcium, and mixtures thereof are preferred.

Step (iii)—comprises a step which allows the formulator the ability to pre-combine any suitable adjunct ingredients or carriers with the selected —$NH_2$ compound prior to combining the —$NH_2$ compound with the pre-mix that is formed in step (i).

Step (iv)—comprises a step wherein the pre-mix obtained in step (i) of the present invention is combined with the —$NH_2$ compound that was selected in step (ii) or alternatively the —$NH_2$ composition (which includes adjuncts and carriers) that was pre-combined in step (ii). The resulting solution has a final pH of greater than 11 and is an improved bleaching composition.

Step (iv) according to the process of the present invention may be followed by further steps for example, a dilution step. Typically for better storage stability, such a dilution step is not carried out in the plant, but it may be carried out by the consumer who uses the composition. Dilution can result in pH variation, typically including pH decrease.

According to the present invention the process conditions generally applicable are those generally known by those skilled in the art. Thus, mixing can be accomplished using any convenient means such as a magnetic or mechanically driven stirrer. Typical step reaction times can be in the range from about 1 minute to about 2 hours depending on mixing scale.

The present process is typically performed at a temperature range from about 5° C. to about 80° C., preferably from about 10 to about 45° C. and more preferably at ambient temperature. At higher temperatures, there may be an increased decomposition tendency and at lower temperatures, freezing can be a problem.

By the process of the present invention, step (i) and steps (ii) and (iii), can be carried out in any order, i.e. (i) before (ii) and (iii), or (ii) and (iii) before (i), provided that step (ii) is always performed before step (iii). Also it is essential that said steps are followed by step (iv), i.e. by combining the pre-mix resulting from step (i) with the —$NH_2$ compound of step (ii) or the —$NH_2$ composition of step (iii) to form a bleaching composition.

Each of the steps (i) and (iii), can have one or more mixing steps. Indeed there may be pre-processing steps, such as dissolving solids in water if the raw materials are available in solid form. The process according to the present invention may also include post-processing steps, such as diluting the composition resulting from step (iv).

In the embodiment of the present invention where the compositions obtainable according to the process of the present invention further comprise one or more optional ingredient as mentioned herein after, said ingredients may be added into the compositions step (iii) or added thereafter. Non-limiting examples of bleaching compositions that are further modified after step (iv) are, for example, a bleaching composition that is diluted with water prior to packaging or a bleaching composition wherein an inert material, such as an abrasive is added. Also step (iii) may comprise one or more steps of mixing said organic or inorganic derived —NH2 compound with said carrier and/or said optional ingredient.

Steps (i) and (iii) are carried out preferably in presence of a carrier. By "carrier" it is meant herein any carrier known to those skilled in the art including solid and/or liquids, for example, water.

In the present invention it is essential that the process comprises said pre-mix step wherein said hypoclorite source is mixed together with said source of bromine separately from said organic or inorganic derived —NH2 compounds. Without being limited by theory, it is believed that the order of combining ingredients, that is, first combining a source of hypochlorite with a source of bromine prior to combining with an —$NH_2$ compound is essential to producing a bleaching composition with increased efficacy.

For the purposes of the present invention, "improved bleaching" is meant herein that a bleaching composition obtainable by the process of the present invention delivers better bleaching performance on bleachable stains, for example, tea stains, when compared to the bleaching performance delivered by the same composition made by an alternative process, for example by a process comprising the steps of: (a) predissolving said —$NH_2$ compound with said source of bromine; (b) mixing the mixture of (a) with the remaining components of the composition not including a hypochlorite halogen bleach; (c) adding NaOH to raise pH to about 13.0, and (d) combining a hypochlorite halogen bleach and the mixture from (c), by adding the hypochlorite to the mixture of (c).

The present invention comprises organic or inorganic derived —NH2 compound as a means for controlling malodor or "bleached hand smell" on the skin. While not intending to be limited by theory, the principle component of "Bleached Hand" malodor on the skin is 1-pyrroline. This material is formed from the amino acid L-proline when the keratin protein found in the stratum corneum layers of the skin is exposed to free positive halogen, especially positive chlorine. The rate of formation and the amount of 1-pyrroline that is formed varies from individual to individual but the general mechanism of formation is believed to be universal. The degradation of skin protein is believed to begin with the rapid halogenation of a protein amide bond nitrogen when the skin is exposed to solutions containing hypohalite. If this N-halogenation occurs adjacent to the amino acid L-proline, the ensuing protein fragmentation results in the formation of 1-pyrroline. The rate of protein degradation, once the N-halogenation has occurred is variable from individual to individual and, in some cases, formation of malodor on the skin continues for several days after exposure to "free available halogen".

The present invention also encompasses hard surface cleaning compositions obtainable according to the present process, the compositions comprising a halogen bleach, a source of bromine and an organic or inorganic derived —NH2 compound. The compositions obtainable according to said process can be formulated in a variety of different embodiments, especially as household cleaners.

The compositions obtainable by the process of the present invention comprise from about 0.01% to about 10% of said halogen bleach or mixtures thereof, expressed as available chlorine ($AVCl_2$), preferably about 0.01% to about 5%, more preferably from about 0.1% to about 2.5%, most preferably from about 0.5% to about 2.5%, by weight.

The compositions obtainable according to the process of the present invention comprise said source of bromine or mixtures thereof that are present such that the mole ratio of halogen bleach to said source of bromine is from about 1:0.1 to about 1:2, preferably from about 1:0.2 to about 1:1.

The compositions obtainable according to the process of the present invention comprise said organic or inorganic derived —NH2 compound or mixtures thereof such that the mole ratio of halogen bleach to said organic or inorganic derived —NH2 compound is from about 10:1 to about 1:10, preferably from about 5:1 to about 1:2, more preferably from about 3:1 to about 1:2.

A preferred embodiment of the present invention encompasses a process of manufacturing a bleaching composition comprising the steps of:

i) mixing at a temperature from about 5° C. to about 80° C. a source of hypochlorite and a source of bromine to form a pre-mix;

ii) selecting an organic or an inorganic derived —$NH_2$ compound;

iii) optionally mixing at a temperature from about 5° C. to about 80° C. the selected —$NH_2$ compound with a carrier or/and an optional ingredient to form an —$NH_2$ composition; and iv) combining the pre-mix from step (i) with the —$NH_2$ compound of step (ii) or the —$NH_2$ composition of step (iii) to form a bleaching composition, wherein the pH of the bleaching composition is greater than 11.

The process of the present invention has several advantages. The pre-mix obtained in step (i) of the present process can be simultaneously metered into several compositions, each a different embodiment of the present invention. For example, a first feed line may direct the pre-mix obtained in step (i) for combination with a selected —$NH_2$ compound obtained in step (ii) while a second feed line directs the pre-mix of step (i) to a —$NH_2$ composition derived from step (iii) of the present process comprising detersive surfactant, buffers, builders, and other optional ingredients or carriers. Another advantage is the flexibility it affords the bleaching composition formulator. Indeed the process of the present invention can be conveniently conducted in a single manufacturing location as well as in different locations. It is thus possible to have at least part of the process carried out in more than one location, for example to reduce the cost of shipping water. In this mode, for example, a stable pre-mix composition according to step (1) can be transported safely from one location to second location where the final formulation is accomplished.

A further advantage of the process of the present invention is the usage of alternative forms of bromine, for example, the instant process can utilize elemental bromine ($Br_2$), salts (i.e. NaBr), as well as suitable organic bromides (i.e. N-bromo-succinimide) and the like. Another advantage of the process of the present invention is the use of any source of hypochlorite. The concentration level of hypochlorite in step (i) is not restricted to the levels commercially available to the formulator but may also comprise concentrations produced by a manufacturing-site process, for example, the passing of chlorine gas into an alkaline aqueous solution. The latter process example, depending upon the choice of alkali, allows the formulator to incorporate selected cations (e.g. $K^+$, $Ca^{2+}$) into the final formulation.

An advantage of said compositions obtainable according to the process of the present invention is that they can be applied to hard surfaces to be cleaned or bleached using any convenient method of application.

Another advantage of the compositions obtainable according to the process of the present invention is that they can be provided in various forms including any convenient form, e.g., solid, semi-solid, gel or paste or liquid.

Yet another advantage of the present invention is that bleaching compositions are provided which not only exhibit excellent bleaching performance but which also reduce chlorine bleach malodor on the skin. Indeed, the compositions obtainable according to the process of the present invention because of their effectiveness in controlling hypohalite derived malodor on the skin, preclude the necessity of gloves or other protection of the exposed skin during cleaning.

The compositions obtainable according to the process of the present invention may further comprise optional ingredients, e.g., one or more detergent adjunct materials or other materials for assisting or enhancing cleaning performance, treatment of the surface to be cleaned, or to modify the aesthetics of the composition (e.g., perfumes, colorants, dyes, etc.). The conventional optional ingredients to be used in the compositions obtainable according to the process of the present invention further include surfactants, bleach stabilizers, pigments, color speckles, suds boosters, suds suppressers, anti-tarnish and/or anti-corrosion agents, soil-suspending agents, germicides, alkalinity sources, hydrotropes, anti-oxidants, clay soil removal/anti-redeposition agents, polymeric dispersing agents and the like and mixtures thereof. The following are illustrative examples of such optional ingredients but are not meant to be exclusive or limiting in scope.

The compositions obtainable according to the process herein have a pH greater than 11, preferably at least 12 and most preferably at least 13. Accordingly said compositions obtainable according to the present invention preferably comprise a pH-adjusting agent such as common mineral acids or bases. Suitable pH adjusting agents to be used herein include any convenient alkaline pH adjusting agent. However it is essential throughout the present process that alkaline pH adjusting agent is non-reactive with hypochlorite. Preferred alkaline pH adjusting agents include water-soluble alkalis such as sodium hydroxide, potassium hydroxide or mixtures thereof. It is preferable herein not to use ammonia which is an example of a generally unsuitable pH-adjusting agent because it is chemically reactive for purposes other than pH change and forms an undesirable type of chloramine with hypochlorite.

The compositions obtainable according to the process herein may comprise from about 0.1% to about 95% by weight of a surfactant or mixtures thereof selected from the group consisting of anionic, nonionic, ampholytic and zwitterionic surface active agents. For liquid systems, surfactant is preferably present to the extent of from about 0.1% to 20% by weight of the composition. For solid (i.e. granular) and viscous semi-solid (i.e. gelatinous, pastes, etc.) systems, surfactant is preferably present to the extent of from about 1.5% to 30% by weight of the composition.

Anionic surfactants can be broadly described as the water-soluble salts, particularly the alkali metal salts, of organic sulfuric reaction products having in their molecular structure an alkyl radical containing from about 8 to about 22 carbon atoms and a radical selected from the group consisting of sulfonic acid and sulfuric acid ester radicals. (Included in the term alkyl is the alkyl portion of higher acyl radicals.) Important examples of the anionic synthetic detergents which can form the surfactant component of the compositions of the present invention are the sodium or potassium alkyl sulfates, especially those obtained by sulfating the higher alcohols (C8–18 carbon atoms) produced by reducing the glycerides of tallow or coconut oil; sodium or potassium alkyl benzene sulfonates, in which the alkyl group contains from about 9 to about 15 carbon atoms, (the alkyl radical can be a straight or branched aliphatic chain); sodium alkyl glyceryl ether sulfonates, especially those ethers of the higher alcohols derived from tallow and coconut oil; sodium coconut oil fatty acid monoglyceride sulfates and sulfonates; sodium or potassium salts of sulfuric acid ester of the reaction product of one mole of a higher fatty alcohol (e.g. tallow or coconut alcohols) and about 1 to about 10 moles of ethylene oxide; sodium or potassium salts of alkyl phenol ethylene oxide ether sulfates with about 1 to about 10 units of ethylene oxide per molecule and in which the alkyl radicals contain from 8 to 12 carbon atoms; the reaction products of fatty acids are derived from coconut oil sodium or potassium salts of tatty acid amides of a methyl tauride in which the fatty acids, for example, are derived from coconut oil and sodium or potassium beta-acetoxy- or beta-acetamido-alkanesulfonates where the alkane has from 8 to 22 carbon atoms.

Additionally, secondary alkyl sulfates may be used by the formulator exclusively or in conjunction with other surfactant materials and the following identifies and illustrates the differences between sulfated surfactants and otherwise conventional alkyl sulfate surfactants. Non-limiting examples of such ingredients are as follows.

Conventional primary alkyl sulfates, such as those illustrated above, have the general formula ROSO3−M+ wherein R is typically a linear $C_8$–$C_{22}$ hydrocarbon group and M is a water solublizing cation. Branched chain primary alkyl sulfate surfactants (i.e., branched-chain "PAS") having 8–20 carbon atoms are also know; see, for example, Eur. Pat. Appl. 439,316, Smith et al., filed Jan. 21, 1991.

Conventional secondary alkyl sulfate surfactants are those materials which have the sulfate moiety distributed randomly along the hydrocarbyl "backbone" of the molecule. Such materials may be depicted by the structure $$CH_3(CH_2)_n(CHOSO_3^-M^+)(CH_2)_mCH_3$$

wherein m and n are integers of 2 or greater and the sum of m+n is typically about 9 to 17, and M is a water-solublizing cation.

In addition, the selected secondary (2,3) alkyl sulfate surfactants used herein may comprise structures of formulas I and II $$CH_3(CH_2)_x(CHOSO_3^-M^+)CH_3 \quad \text{I}$$

$$CH_3(CH_2)_y(CHOSO_3^-M^+)CH_2CH_3 \quad \text{II}$$

for the 2-sulfate and 3-sulfate, respectively. Mixtures of the 2- and 3-sulfate can be used herein. In formulas I and II, x and (y+l) are, respectively, integers of at least about 6, and can range from about 7 to about 20, preferably about 10 to about 16. M is a cation, such as an alkali metal, ammonium, alkanolammonium, triethanol-ammonium, potassium, ammonium, and the like, can also be used.

The aforementioned secondary alkyl sulfates are those prepared by the addition of $H_2SO_4$ to olefins. A typical synthesis using alpha olefins and sulfuiric acid is disclosed in U.S. Pat. No. 3,234,258, Morris, issued Feb. 8, 1966 or in U.S. Pat. No. 5,075,041, Lutz, issued Dec. 24, 1991. The synthesis conducted in solvents which afford the secondary (2,3) alkyl sulfates on cooling, yields products which, when purified to remove the unreacted materials, randomly sulfated materials, unsulfated by-products such as C10 and higher alcohols, secondary olefin sulfonates, and the like, are typically 90+% pure mixtures of 2- and 3-sulfated materials (some sodium sulfate may be present) and are white, non tacky, apparently crystalline, solids. Some 2,3-disulfates may also be present, but generally comprise no more than 5% of the mixture of secondary (2,3) alkyl mono-sulfates. Such materials are available as under the name "DAN", e.g., "DAN 200" from Shell Oil Company.

The compositions obtainable according to the process of the present invention which are formulated in a solid or viscous semi-solid form may further comprise an abrasive material, said material may facilitate the action of scouring. Abrasive scouring cleansers provide a convenient and useful means for carrying out the sanitizing of porcelain and tile surfaces, especially tubs, showers and toilet bowls. The particulate abrasive material within such compositions serves to abrade and loosen soil adhering to hard surfaces and further serves to create more intimate contact between hard surface stain and the surfactant and/or bleaching agents also present in the cleansing compositions. Abrasive cleaners have traditionally contained water-insoluble, relatively hard, particulate mineral material as the abrasive agent. The most common such abrasive agent is finely divided silica sand having particle size varying between about 1 and 300 microns and specific gravity of about 2.1 or higher. While such material is generally very effective in scouring soil and stains from the surfaces being treated, abrasive material of this type tends to be difficult to rinse away from the toilet bowl, shower or bathtub surface. It has been discovered that abrasive compositions of this desired type can be realized by utilizing a particular type of expanded perlite abrasive in combination with the surfactants, filler material, and other optional scouring material ingredients listed herein. The abrasive materials suitable to the present invention are those contained in U.S. Pat. No. 4,051,056, Hartman, issued Sep. 27, 1977 and included herein by reference.

Other optional ingredients to be used herein include buffers. One such purpose is to adjust the cleaning surface pH to optimize the hard surface cleaner composition effectiveness relative to a particular type of soil or stain. Buffers may be included to stabilize the adjunct ingredients with respect to extended shelf life or for the purpose of maintaining compatibility between various aesthetic ingredients. The hard surface cleaner of the present invention optionally contains buffers to adjust the pH in a range above 11. Non-limiting examples of such suitable buffers are potassium carbonate, sodium carbonate, and trisodium phosphate, however, the formulator is not restricted to these examples or combinations thereof.

The cleaning compositions obtainable according to the process of the present invention may also optionally contain one or more iron and/or manganese chelating agents. Examples of such compatible chelating agents are ethane-1-hydroxy-1,1-diphosphonic acid (EHDP) and dipicolinic acid.

Perfumes are also an important optional ingredient especially for the liquid composition embodiment. Perfume is usually used at levels of from 0% to 5%. In U.S. Pat. No. 4,246,129, Kacher, issued Jan. 20, 1981 (incorporated herein by reference), certain perfume materials are disclosed which perform the added function reducing the solubility of anionic sulfonate and sulfate surfactants.

The compositions obtainable according to the present invention may be formulated either as solids or liquids, but are preferably used in a liquid form to household cleaning application. In the case where the compositions are formulated as solids, they will thus be mixed with an appropriate solvent, typically water, before use. In liquid form, the compositions are preferably but not necessarily formulated as aqueous compositions. Also suitable carriers for the present invention are water and volatile solvents that are compatible with hypohalite. The liquid compositions obtainable according to the process of the present invention may be formulated with different viscosities. In one embodiment of the present invention the compositions obtainable with the process herein have a viscosity of from about 1 to about 150 cps. Said compositions are convenient for spray bottle application. Likewise, said liquid compositions obtainable according to the present invention can be further thickened, e.g., by the addition of additional bleach-stable thickener, such as the commercially available DOWFAX. A suitable gel formulation has a viscosity of from about 100 cps to about 2000 cps, preferably from 300 cps to 1000 cps as measured, for example, by techniques and methods described in "Physico-Chemical Methods", Reilly, J. and Rae, W. N.; Vol. 1 (5th ed.), pages 667–692; D. Van Nostran pub.

EXAMPLES

The following compositions were made by the listed ingredients in the listed proportion according to the process of the present invention.

All percentages herein are percentages by weight on an anhydrous basis, unless otherwise noted.

| | Example No. | | | | | | |
|---|---|---|---|---|---|---|---|
| Component | 1 | 2 | 3 | 4 | 5 | 6 | 7 |
| surfactant | 0.25 | 3.5 | 5.5 | 6.5 | 6.1 | 6.0 | 5.2 |
| sulphamic acid | 1.30 | 1.9 | 2.2 | — | — | 2.5 | 2.3 |
| sodium sulfamate | — | — | — | 0.5 | — | — | — |
| melamine | — | — | — | — | 0.23 | — | — |
| sodium hypochlorite | 0.9 | 1.4 | 1.4 | — | — | 1.7 | 1.5 |
| calcium hypochlorite | — | — | — | 0.5 | — | — | — |
| sodium dichlorocyanurate | — | — | — | — | 1.2 | — | — |
| tetrapotassium pyrophos. | 6.0 | — | — | — | 13.0 | — | — |
| tripotassium phosphate | 2.0 | — | — | — | 12.0 | — | — |
| sodium tripolyphosphate | — | — | — | 1.6 | — | — | — |
| sodium silicate | — | 0.04 | 0.05 | — | 0.5 | 0.1 | 0.2 |
| sodium periodate | — | 0.01 | — | — | — | — | 0.05 |
| sodium acetate | — | — | — | 0.3 | — | — | — |
| sodium bromide | — | 1.8 | 1.5 | — | — | 0.5 | 0.6 |
| sodium iodide | — | — | 0.03 | — | — | — | — |
| potassium bromide | 1.1 | — | 1.1 | 1.5 | 1.0 | — | — |
| perfume | — | 0.28 | 0.1 | — | — | 0.3 | 0.35 |
| calcium carbonate | — | — | — | — | 39.0 | — | — |
| calcium oxide | — | — | — | — | 2.8 | — | — |
| perlite abrasive | 6.5 | — | — | — | 22.5 | — | — |
| sodium hydroxide | 0.8 | 1.6 | 1.8 | 0.8 | 1.1 | 2.8 | 2.6 |
| potassium hydroxide | — | — | — | 0.85 | — | — | — |
| dyes | 0.75 | 0.28 | 0.28 | 0.28 | — | — | 0.01 |
| miscellaneous | — | — | 0.02 | — | — | — | — |
| moisture/distilled water | bal. | bal. | bal. | bal. | bal. | bal. | bal. |

All the compositions herein obtainable according to the process of the present invention delivered excellent bleaching property when used to treat surfaces as well as reduced chlorine bleach malodor on the skin.

The following processes illustrating the present invention were carried out at room temperature. All the percentages are percentages by weight of the finished compositions obtainable according to the process of the present invention unless otherwise indicated:

In process A a pre-mix is formed (ph=13) by combining Na hypochlorite (15% solution in water) together with NaBr in amounts sufficient to provide respectively 1.4% and 0.5% in the finished composition (step (i)). Sulfamic acid is selected as the —$NH_2$ compound and combined with adjunct ingredients to form an —$NH_2$ composition comprising water (balence), NaOH (2.4%), 3 ratio Na Silicate (0.4%), sulfamic Acid (2.2%), surfactants (C8AS, C12 Amine Oxide and C16 Amine Oxide at 1.1%, 2.4% and 0.1% respectively), perfume (0.2%) and dye (0.0046%) (step (ii) and (iii)). The pre-mix is then combined with the —$NH_2$ composition to form a bleaching composition having a final pH of 13.1.

In process B a pre-mix is formed (ph=12.8) by combining Na hypochlorite (15% solution in water) together with a 40% NaBr solution in water, in amounts sufficient to provide respectively 1.7% and 0.5% in the finished composition (step (i)). Sulfamic acid is selected as the —$NH_2$ compound and combined with optional ingredients to form an —$NH_2$ composition comprising water (balance), NaOH (3.0%), 3 ratio Na Silicate (0.05%), sulfamic Acid (2.5%), surfactants (C8AS, C12 AS at 4.0%, and 2.0% respectively), and perfume (0.3%). The pre-mix is then combined with the —$NH_2$ composition to form a bleaching composition having a final pH of 13.2.

What is claimed is:

1. A process for manufacturing a liquid bleaching composition, said process comprising the steps of:

i) mixing a source of hypochlorite and a source of bromide to form a pre-mix;

ii) selecting an organic or an inorganic derived —$NH_2$ compound;

iii) optionally mixing the selected —$NH_2$ compound with one or more carriers and/or one or more adjunct ingredients to form an —$NH_2$ containing composition; and iv) combining the pre-mix from step (i) with the —$NH_2$ compound of step (ii) or the —$NH_2$ composition of step (iii) to form a bleaching composition;

wherein the pH of said bleaching composition is greater than 11.

2. A process according to claim 1 wherein said source of hypochlorite is selected from the group consisting of alkali metal hypochlorite, alkaline earth metal hypochlorite, hypochlorous acid, chlorine, chloroisocyanurate, and mixtures thereof.

3. A process according to claim 1 wherein said source of bromide is selected from the group consisting of $Br_2$, NaOBr, a salt having the formula $M(X)_y$ wherein M is selected from the group consisting of lithium, sodium, potassium, magnesium, calcium, copper, zinc, or mixtures thereof; X is selected from the group consisting of bromide, bromate, or mixtures thereof; y is 1 or 2; and mixtures thereof.

4. A process according to claim 3 wherein said source of bromide is sodium bromide.

5. A process according to claim 1 wherein said —$NH_2$ compound is selected from the group consisting of sulphamic acid, sodium sulphamate, potassium sulphamate, sulfamide, p-toluenesulphonamide, imidodisulphonamide, benzenesulphonamide, melamine, cyanamide, alkyl sulfonamide, and mixtures thereof.

6. A process according to claim 1 wherein said adjunct ingredient admixed in step (iii) is selected from the group consisting of surfactants, buffers, chelants, abrasives, perfumes, colorants, dyes, bleach stabilizers, pigments, color speckles, suds suppressors, anti-tarnish agents, anti-corrosion agents, soil suspending agents, germicides, alkalinity sources, hydrotropes, anti-oxidants, clay soil removal agents, polymeric dispersing agents, thickeners, and mixtures thereof.

7. A process according to claim 6 wherein said adjunct ingredients are admixed with said bleaching composition after step (iv).

8. A process according to claim 1 wherein said source of hypochlorite is present in a ratio to said source of bromide from about 1:0.1 to about 1:2.

9. A process according to claim 8 wherein said ratio of hypochlorite to bromide is from about 1:0.2 to about 1:1.

10. A process according to claim 1 wherein said source of hypochlorite is present in a ratio to said —$NH_2$ compound from about 10:1 to about 1:10.

11. A process according to claim 10 wherein said ratio of hypochlorite to —$NH_2$ compound is from about 5:1 to about 1:2.

12. A process according to claim 11 wherein said ratio of hypochlorite to —$NH_2$ compound is from about 3:1 to about 1:2.

13. A process according to claim 1 wherein said bleaching compound obtained from step (iv) from about 0.01% to about 10% available chlorine.

14. A process according to claim 13 wherein said bleaching compound obtained from step (iv) from about 0.01% to about 5% available chlorine.

15. A process according to claim 14 wherein said bleaching compound obtained from step (iv) from about 0.1% to about 2.5% available chlorine.

16. A process according to claim 15 wherein said bleaching compound obtained from step (iv) from about 0.5% to about 2.5% available chlorine.

17. A process according to claim 1 further comprising the step of adding a carrier to the pre-mix formed in step (i).

18. A process according to claim 17 wherein said carrier is water.

19. A process for manufacturing a liquid bleaching composition, said process comprising the steps of:

i) mixing an aqueous solution of NaOCl wherein said NaOCl solution comprises from about 0.01% to about 10% available chlorine and NaBr to form a pre-mix; and ii) mixing an —$NH_2$ compound selected from the group consisting of sulphamic acid, sodium sulphamate, potassium sulphamate, sulfamide, p-toluenesulphonamide, imidodisulphonamide, benzenesulphonamide, melamine, cyanamide, alkyl sulfonamide, and mixtures thereof with said pre-mix from step (i) to form a bleaching composition;

wherein the pH of said bleaching composition is greater than 12.

20. A process for manufacturing a liquid bleaching composition, said process comprising the steps of:

i) mixing an aqueous solution of NaOCl wherein said NaOCl solution comprises from about 0.01% to about 10% available chlorine and NaBr to form a pre-mix;

ii) admixing an —$NH_2$ compound selected from the group consisting of sulphamic acid, sodium sulphamate, potassium sulphamate, sulfamide, p-toluenesulphonamide, imidodisulphonamide, benzenesulphonamide, melamine, cyanamide, alkyl sulfonamide, and mixtures thereof with a surfactant to form a surfactant containing —$NH_2$ admixture; and iii) mixing said surfactant containing —$NH_2$ admixture from step (ii) to form a bleaching composition;

wherein the pH of said bleaching composition is greater than 11.

* * * * *